US009225068B2

(12) United States Patent
Suleiman

(10) Patent No.: US 9,225,068 B2
(45) Date of Patent: Dec. 29, 2015

(54) OMNI-DIRECTIONAL ANTENNA

(75) Inventor: Shady Hasan Suleiman, Burlington, IA (US)

(73) Assignee: Winegard Company, Burlington, IA (US)

( * ) Notice: Subject to any disclaimer, the term of this patent is extended or adjusted under 35 U.S.C. 154(b) by 957 days.

(21) Appl. No.: 13/343,488

(22) Filed: Jan. 4, 2012

(65) Prior Publication Data

US 2012/0169545 A1 Jul. 5, 2012

Related U.S. Application Data

(60) Provisional application No. 61/429,634, filed on Jan. 4, 2011.

(51) Int. Cl.

| | |
|---|---|
| ***H01Q 1/38*** | (2006.01) |
| ***H01Q 9/26*** | (2006.01) |
| ***H01Q 1/36*** | (2006.01) |
| ***H01Q 7/00*** | (2006.01) |

(52) U.S. Cl.

CPC . *H01Q 9/26* (2013.01); *H01Q 1/36* (2013.01); *H01Q 7/00* (2013.01)

(58) Field of Classification Search

CPC ..... H01Q 9/285; H01Q 1/38; H01Q 9/28
USPC ..... 343/700 MS, 809, 795
See application file for complete search history.

(56) References Cited

U.S. PATENT DOCUMENTS

| | | | | |
|---|---|---|---|---|
| 7,692,601 | B2 | 4/2010 | Bisiules et al. | |
| 7,750,856 | B2 | 7/2010 | Cohen | |
| 8,013,800 | B2 | 9/2011 | Zheng et al. | |
| 2006/0109192 | A1 * | 5/2006 | Weigand | 343/795 |
| 2007/0052613 | A1 * | 3/2007 | Gallschuetz et al. | 343/860 |
| 2007/0152901 | A1 * | 7/2007 | Hockey et al. | 343/793 |
| 2009/0079649 | A1 * | 3/2009 | Steghafner et al. | 343/786 |
| 2009/0175562 | A1 * | 7/2009 | Pan et al. | 382/312 |
| 2009/0322629 | A1 * | 12/2009 | Hung et al. | 343/702 |
| 2011/0248900 | A1 | 10/2011 | de Rochemont | |

* cited by examiner

*Primary Examiner* — Dameon E Levi
*Assistant Examiner* — Collin Dawkins
(74) *Attorney, Agent, or Firm* — Dorr, Carson & Birney, PC

(57) ABSTRACT

An omni-directional antenna is made of a series of straight conductor segments of varying lengths that form two symmetrical ear-shaped lobes.

9 Claims, 2 Drawing Sheets

OMNI-DIRECTIONAL ANTENNA

RELATED APPLICATION

The present application is based on and claims priority to the Applicant's U.S. Provisional Patent Application 61/429,634, entitled "Omni-Directional Antenna," filed on Jan. 4, 2011.

BACKGROUND OF THE INVENTION

1. Field of the Invention

The present invention relates generally to the field of antennas. More specifically, the present invention discloses a compact omni-directional antenna.

2. Statement of the Problem

Many different types of antennas have been used in the past to receive digital television (DTV) signals. The prior art in this field includes many efforts to approximate omni-directional or elliptical patterns. However, a number of other factors must be accommodated as well in designing a commercially-viable and practical antenna. In particular, antennas are typically required to receive a wide frequency band or a number of separate frequency bands. But, this can tend to add complexity and cost to the antenna design in an effort to provide performance over a wide frequency band. Ideally, an antenna should also be easy to manufacture and be low-cost.

Another factor is the size of the antenna. For example, small portable entertainment modules for use in vehicles and handheld devices impose significant size constraints on antennas, particularly if the antenna is to be located within the device housing.

These design considerations tend to involve trade-offs and compromises to achieve an acceptable antenna design. Therefore, a need continues to exist in the electronics industry for a compact omni-directional antenna that is capable of handling a wide bandwidth and that can be easily manufactured at low cost.

3. Solution to the Problem

The present invention effectively balances these design considerations by providing an omni-directional antenna made of a series of straight conductor segments of varying lengths that form two symmetrical ear-shaped lobes. This configuration generates antenna patterns that are approximately omni-directional or elliptical in the horizontal plane across a wide bandwidth. In particular, the plurality of segments of different lengths and bends of different angles result in antenna patterns that are approximately omni-directional or elliptical in shape across the high VHF and UHF bands.

Another advantage is that the present antenna is compact. The present invention is optimized for compactness and for low cost, so it can be used in ATSC/MH applications inside and outside vehicles and for use indoors or outdoors in HDTV residential applications. Furthermore, the present antenna is easy to manufacture and assemble, and is aesthetically pleasing.

SUMMARY OF THE INVENTION

This invention provides an omni-directional antenna made of a series of straight conductor segments of varying lengths that form two symmetrical ear-shaped lobes.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 2:
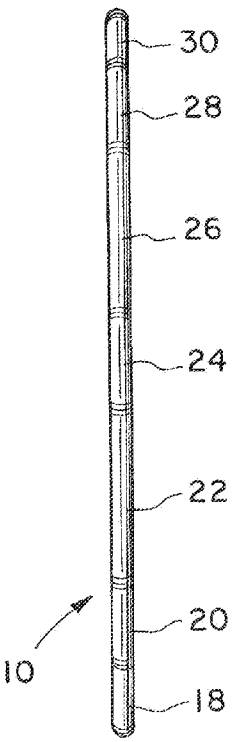
FIG. 2 is a right side elevational view of the antenna 10.
Figure 4:
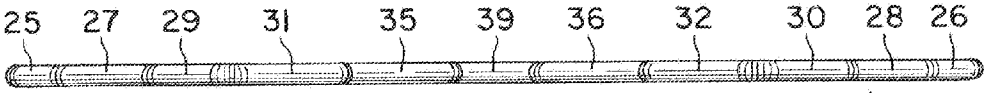
FIG. 4 is a top view of the antenna 10.
Figure 1:
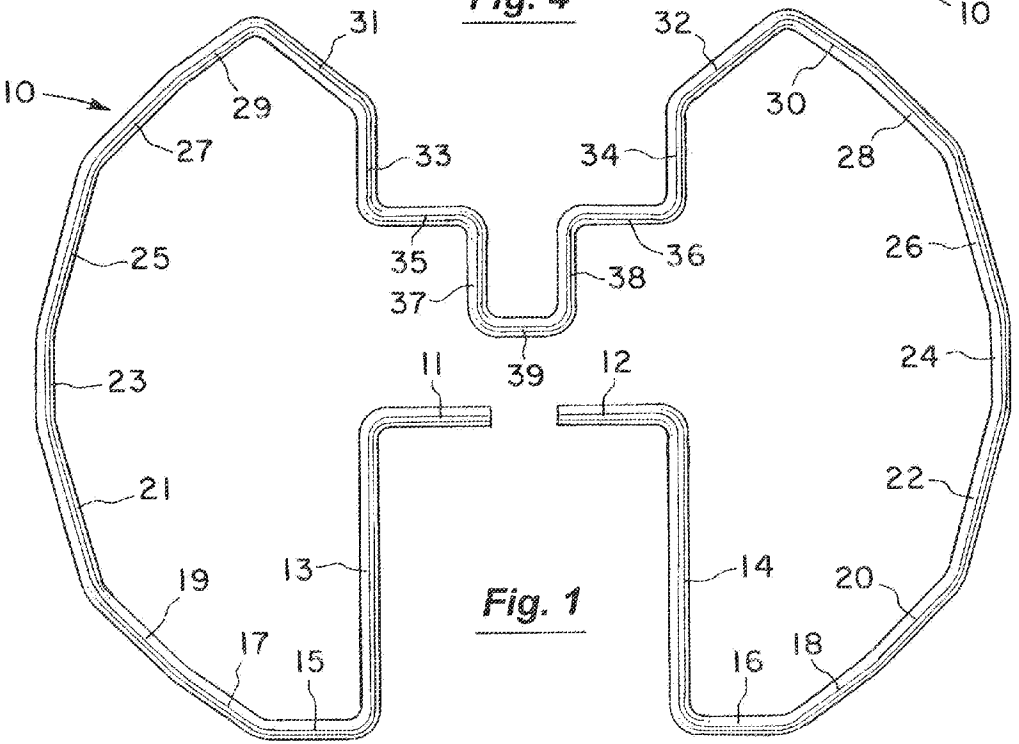
FIG. 1 is a front elevational view of an embodiment of the present antenna 10.
Figure 3:
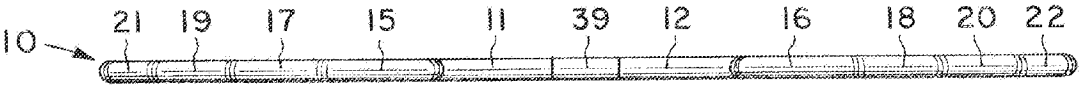
FIG. 3 is a bottom view of the antenna 10.

Turning to FIG. 1, a front elevational view is provided showing an embodiment of the present omni-directional antenna 10. Corresponding right side, bottom and top views of this antenna 10 are depicted in FIGS. 2-4, respectively. This embodiment of the antenna 10 is created by a single electrical conductor that has been formed into the shape shown in FIG. 1. For example, the antenna 10 can be fabricated by bending a single piece of aluminum or copper wire. Alternatively, the antenna 109 can be made from a conductive ink printed on a substrate made of a dielectric material, or formed as a conductive trace on a dielectric substrate, such as a printed circuit board or flexible circuit substrate. The antenna could also be made from multiple electrical conductors.

The antenna 10 is generally planar with two ear-shaped lobes that extend laterally outward from an axis of symmetry. The electrical conductor runs continuously between the antenna inputs 11 and 12 through both ear-shaped lobes to form a dipole antenna. However, the electrical conductor is a series of substantially straight segments 11-39 of varying lengths separated by bends of different angles. In other words, the various antenna segments 11-39 have a wide variety of orientations in the plane of the antenna 10. The antenna segments 15-29 and 16-30 that form the outer perimeters of the ear-shaped lobes of the antenna 10 approximate chords or tangents of a curve.

More specifically, the input segments 11 and 12 extend horizontally outward from the axis of symmetry. These input segments 11, 12 are typically connected to a balun transformer (not shown), which delivers the antenna signal to an amplifier for the remaining stages of the receiver. The spacing at the inputs 11, 12 of the antenna can be varied between ⅛ inch to ⅝ inch. The transformer/amplifier board is typically be placed at the inputs 11, 12 the antenna 10 and the spacing of the contact points on the board will match the spacing on the antenna inputs.

Two longer antenna segments 13 and 14 continue downward at right angles from the output segments. The open area bordered by antenna segments 11-14 is made to accommodate an antenna balun and antenna amplifier, if needed. The lower ends of antenna segments 13, 14 define the lower extremities of the ear-shaped lobes. From there, a series of shorter antenna segments 15-29 and 16-30 form the outer perimeters of the ear-shaped lobes by approximating rounded curves, as previously discussed. At the upper ends of the ear-shaped lobes, two antenna segments 31 and 32 extend diagonally inward and downward. A series of alternating horizontal and vertical segments 33-37 and 34-38 create zigzag patterns that converge diagonally inward and downward at horizontal segment 39 to join the lobes of the antenna 10.

The present antenna is designed primarily to receive ATSC/MH (Advanced Television Systems Committee/Mobile Handheld) and high-definition digital television signals. In particular, the embodiment of the present antenna depicted in the accompanying figures is designed to receive signals in the high VHF (174 to 216 MHz) and UHF (470 to 698 MHz) bands. Antenna segments 23, 25, 27, 29, 31, 33, 35, 37, 38, 39,

36, 34, 32, 30, 28, 26 and 24 are largely responsible for generating antenna patterns that are approximately omni-directional or elliptical in the horizontal plane across the high VHF and UHF bands. Overall dimensions of approximately 9.24×6.81 in. have been found to be satisfactory for these frequency bands. However, it is anticipated that other dimensions and lobe shapes could be used, particularly if other bands are of interest.

For example, this embodiment of the present antenna can be used in a portable entertainment center or a mobile hand-held device as an internal or external antenna. As an internal antenna, it can be embedded in the plastic housing of the device. It could also be used for indoor or outdoor DTV residential applications. Although the specific embodiment of the antenna 10 shown in the accompanying drawings is intended primarily for use in the high VHF and UHF bands for television, the present antenna 10 could also be readily adapted for use in other frequency bands and other fields of use, such as medical telemetry. It should be understood that the present antenna can be used for either receiving or transmitting, and thus can be used in conjunction with a transceiver.

Figure 5:
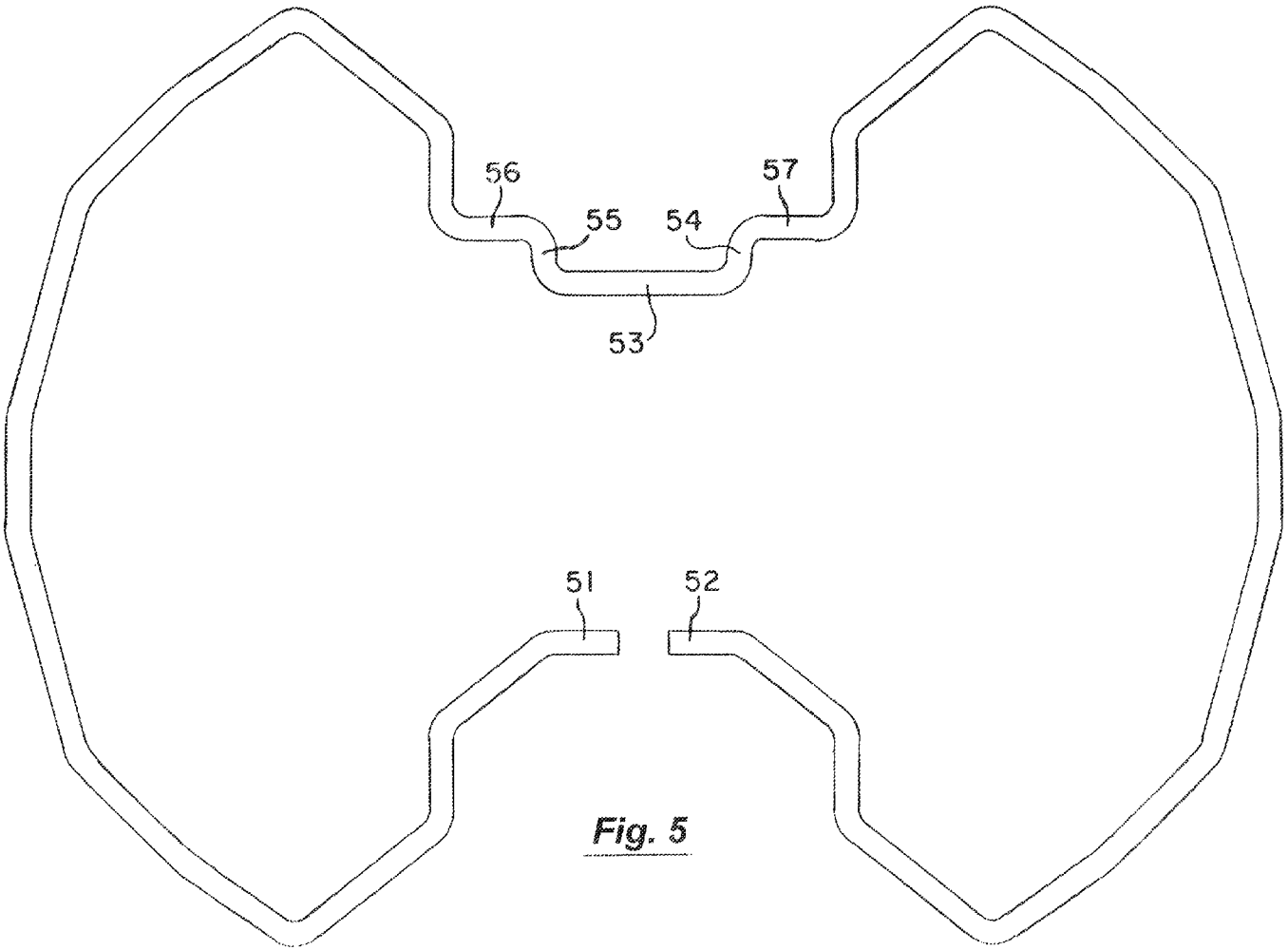
FIG. 5 is front elevational view of another embodiment of the present antenna 10.

FIG. 5 is a front elevational view of a second embodiment of the antenna 10 that has been optimized to increase its gain for channel 27 (i.e., the frequency band from 548 to 554 MHz). This application is for emergency management where the antenna can be placed inside police cars to receive and transmit data. The placement of the antenna in a police car can be in the horizontal or vertical plane. Increasing the vertical distance between antenna segment 53 and antenna segment 51, and between antenna segment 53 and antenna segment 52, and adjusting the lengths of antenna segments 53, 54, 55, 56 and 57 results in an increased gain on average of about 1 to 2 dB over this frequency band.

When the region defined by antenna segments 53-57 in FIG. 5 is inverted and the spacing relative to antenna segments 51 and 52 is increased, the result is a decreased gain. Therefore, it is important to maintain the shaped produced by antenna segments 53-57 to increase the gain of the channel 27 frequency band.

The antennas shown in FIGS. 1 and 5 are scalable in frequency. However, when scaling the antennas, the resulting patterns in the horizontal plane may not be approximately omni-directional or elliptical. Further tuning and adjustments of the antenna segments may be need after scaling to generate omni-directional or elliptical shapes.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

I claim:

1. An omni-directional antenna comprising an electrical conductor extending between antenna inputs spaced apart from one another about an axis of symmetry and running continuously through two human ear-shaped lobes extending symmetrically about the axis to form a dipole antenna, wherein the electrical conductor is made of a series of substantially straight segments of varying lengths separated by bends of different angles forming the outer perimeters of the lobes by a series of chords approximating rounded curves.

2. The omni-directional antenna of claim 1 wherein the lobes are planar.

3. The omni-directional antenna of claim 1 wherein the electrical conductor comprises a bent wire.

4. The omni-directional antenna of claim 1 wherein the electrical conductor comprises conductive ink on a dielectric material.

5. The omni-directional antenna of claim 1 wherein the electrical conductor comprises a conductive trace on a dielectric substrate.

6. An omni-directional antenna comprising an electrical conductor extending between antenna inputs spaced apart from one another about an axis of symmetry and running continuously through two planar, human ear-shaped lobes extending laterally outward from the axis of symmetry to form a dipole antenna, wherein the electrical conductor is made of a series of substantially straight segments of varying lengths separated by bends of different angles forming the outer perimeters of the lobes by a series of chords approximating rounded curves.

7. The omni-directional antenna of claim 6 wherein the electrical conductor comprises a bent wire.

8. The omni-directional antenna of claim 6 wherein the electrical conductor comprises conductive ink on a dielectric material.

9. The omni-directional antenna of claim 6 wherein the electrical conductor comprises a conductive trace on a dielectric substrate.

* * * * *